United States Patent [19]

Geke et al.

[11] Patent Number: 4,578,208

[45] Date of Patent: Mar. 25, 1986

[54] COMPOSITIONS AND PROCESSES FOR CLEANING AND PASSIVATING METALS

[75] Inventors: Jüergen Geke, Duesseldorf; Bernd Stedry, Kempen, both of Fed. Rep. of Germany

[73] Assignee: Henkel Kommanditgesellschaft auf Aktien, Duesseldorf, Fed. Rep. of Germany

[21] Appl. No.: 607,347

[22] Filed: May 4, 1984

[30] Foreign Application Priority Data

May 7, 1983 [DE] Fed. Rep. of Germany ..... 3316724

[51] Int. Cl.[4] ..... C11D 1/34; C11D 17/08

[52] U.S. Cl. ..... 252/135; 252/156; 252/174.16; 252/174.18; 252/174.21; 252/527; 252/DIG. 14; 252/DIG. 17; 134/2; 134/39; 134/40

[58] Field of Search ..... 252/135, DIG. 14, DIG. 17, 252/174.16; 134/2, 39, 40

[56] References Cited

U.S. PATENT DOCUMENTS

| | | | |
|---|---|---|---|
| 3,715,324 | 2/1973 | Hynes et al. | 252/174.16 |
| 3,738,943 | 6/1973 | Kaneko | 252/174.16 |
| 3,951,826 | 4/1976 | Rasmussen | 252/174.16 |
| 4,247,424 | 1/1981 | Kuzel et al. | 252/174.16 |
| 4,539,134 | 9/1985 | Martin et al. | 252/174.16 |

FOREIGN PATENT DOCUMENTS

| | | |
|---|---|---|
| 235149 | 8/1964 | Austria . |
| 8181013 | 6/1983 | European Pat. Off. . |
| 994373 | 6/1965 | United Kingdom . |

*Primary Examiner*—Paul Lieberman
*Assistant Examiner*—Hoa Van Le
*Attorney, Agent, or Firm*—Ernest G. Szoke; Henry E. Millson, Jr.; Mark A. Greenfield

[57] ABSTRACT

Compositions and processes for cleaning and passivating metals wherein the cleaning operation is carried out at temperatures of from room temperature to 100° C. and said compositions are aqueous solutions containing a phosphoric acid ester, an alkanolamine, at least one sprayable surfactant and, optionally, builders, non-ferrous metal inhibitors, and/or biocides.

19 Claims, No Drawings

COMPOSITIONS AND PROCESSES FOR CLEANING AND PASSIVATING METALS

This invention relates to compositions and processes for cleaning and/or passivating metals, as an additive to grinding and crushing waters, and as a passivating agent in cooling circuits.

BACKGROUND OF THE INVENTION

The cleaning of machined metal surfaces by spraying is generally carried out with the use of aqueous cleaners based on organic rustproofing agents, for example, using combinations of alkanolamines and fatty acids, surfactants, antifoam agents and/or phosphonates, optionally in conjunction with biocides and builders. Such cleaners are generally used in the form of aqueous liquids having a pH of from 7.5 to 10.5. Because of this, they are generally called "neutral cleaners".

To avoid undersirable corrosion phenomena, it is often advisable to passivate the metal surface with aqueous solutions containing appropriate chemical additives. This is best done during or after cleaning operations, during machining, or before intermediate storage pending further treatment of the metals.

In the absence of further additives, conventional neutral cleaners and corrosion inhibitors are only suitable for the treatment of iron and steel. Cleaning and passivating agents such as these, which inhibit the corrosion of iron and steel surfaces, contain for example alkali nitrites, alkanolamines, soaps, and benzoates. In addition to ferrous metals, non-ferrous metals and lightweight metals and their alloys, particularly zinc, aluminium and its alloys, are increasingly coming into contact with cleaning and passivating agents. Inhibitors available for non-ferrous metals include, for example, mercaptobenzthiazole and benzotriazole. Unfortunately, these passivating components are attended by the disadvantage that they do not prevent discoloration (i.e., springwater blackening) of the surfaces of lightweight metals. In addition, use of these cleaners on zinc, aluminium and its alloys, results in serious metal erosion which cannot be tolerated in the case of precision parts. In the automotive field, this problem is especially troublesome with respect to the new types of engines and transmissions of lightweight metal alloys.

On the other hand, the trend toward atuomation has produced a demand for cleaner systems not suffering from the above disadvantages.

To enable the cleaning liquids to be automatically controlled and metered, even in tapwater, which is generally done by conductivity measurements, the cleaners hitherto used contain polyphosphates which degrade into pyrophosphates and orthophosphates, especially at elevated temperatures. In many cases, the use of inorganic ions such as these results in precipitates with the salts responsible for the hardness of water, i.e. in deposits of calcium or magnesium phosphate, and—in the presence of aluminum alloys—in the precipitation of aluminium phosphate. This in turn results not only in coatings on the parts to be machined, but also in the adhesion, encrustation or even blockage of machinery components and pumps. In addition, precipitating phosphates, particularly aluminium phosphates, can initiate undesirable coagulation processes, including for example the irreversible binding of surfactants or antifoam agents. This in turn leads to a distinctly greater tendency towards foaming, so that it is not long before the cleaner solution is unfit for further use. Also, as pointed out above, these electrolyte-containing products generally cause increased metal erosion and also very rapid discoloration of the lightweight or nonferrous metal.

DESCRIPTION OF THE INVENTION

It has now surprisingly been found that a combination of certain phosphoric acid esters and alkanolamines in conjunction with sprayable surfactants drastically reduces metal erosion without causing discoloration of the metal surfaces.

Accordingly, the present invention relates to compositions for cleaning and passivating metals, preferably by spraying, which contain:

(a) at least one phosphoric acid ester,
(b) at least one alkanolamine and/or alkanolamine salt,
(c) at least one sprayable nonionic surfactant and, optionally,
(d) builders, complexing agents and/or biocides.

The cleaning agent compositions of the invention are distinguished by the fact that the phosphoric acid ester used in them are of a type which provides for uninterrupted operation without any foaming. This is all the more surprising since, in Austrian application No. 235,149, phosphoric acid esters are described as foam stabilizers.

In addition, the phosphoric acid esters of ethoxylated fatty alcohols, which are preferably used herein, are not affected by calcium and magnesium ions. Accordingly, the inhibition effect on surfaces of various lightweight metals is guaranteed, even in hard water.

Since the agents of the invention do not contain phosphates, there is also no troublesome precipitation of phosphate salts.

By virture of the favorable inhibiting effect of the phosphoric acid esters used in the present compositions, the erosion of aluminium is extremely minimal. In addition, the cleaned metal surfaces show virtually no signs of discoloration. Their inhibiting effect on ferrous metals, but more especially on nonferrous and lightweight metals and zinc, makes the cleaning agents of the invention universally suitable cleaners, for example, for use in large central installations.

The phosphoric acid esters (component (a) above) used herein can be one or more phosphoric acid esters of the following types:

(i) mono- and/or diesters of phosphoric acid with alkanols containing from 10 to 20 carbon atoms and/or water soluble salts thereof;
(ii) mono- and/or diesters of phosphoric acid with ethoxylated and/or propoxylated alkanols containing from 10 to 20 carbon atoms and/or water soluble salts thereof;
(iii) phosphoric acid esters of polyethylene glycol and/or polypropylene glycol ethers and/or water soluble salts thereof.

In the phosphoric acid esters of groups (i) and (ii) above, the alkanol components thereof can be linear or branched, and saturated or unsaturated. Linear fatty alcohols ($C_{10}$–$C_{20}$-alkanols) are preferably used to form Monoesters of phosphoric acid with ethoxylated, linear $C_{10}$–$C_{20}$ alkanols and their sodium, potassium, ammonium or alkanolamine salts are preferably used in the compositions of the invention.

These esters are particularly advantageous in that, when used in the compositions of the invention in aqueous solution, no troublesome foam is produced in spray systems, and this lack of foam results in uninterrupted operation in automatic cleaning machines. Since these ethoxylated, hydrophilic monoesters do not cause any precipitates of calcium or magnesium salts, even in hard water, no coatings which could give rise to corrosion are formed on the cleaned parts. In addition, any precipitates such as the above would result in an unnecessary and ineffectual consumption of the inhibitor which would make practical application virtually impossible. Accordingly, the inhibiting effect of the present compositions containing these monoesters is guaranteed, even in hard water.

In contrast to other cleaners (e.g. those disclosed in European Application No. 81 810 136.6), there is no need to employ zinc salts when the cleaners of the invention are used.

The following compounds are examples of alkanolamines suitable for use as component (b) in the compositions of the invention: mono-, di- and tri-isopropanolamine, n-propanolamine, N,N,N',N'-tetrakis-(2-hydroxyethyl)-ethylene diamine and, preferably, mono-, di-and triethanolamine, either individually or in admixture. Suitable alkanolamine salts are, for example, salts of the above compounds with linear and/or branched mono- and/or dicarboxylic acids and/or sulfonic acid derivatives. In this connection, suitable mono- and/or dicarboxylic acids are, in particular, 2-ethyl hexanoic acid, caprylic acid, isononanoic acid, capric acid and sebacic acid. One example of a suitable sulfonic acid derivative is benzene sulfonyl-N-methyl-ε-aminocaproic acid.

The cleaning solutions contain sprayable, nonionic surfactants (component (c)) of the type which ensure that the solutions can be used and sprayed at any desired process temperature without troublesome foaming. The surfactants in compositions such as these remain dispersed in the cleaning solutions above the cloud point and do not separate out. This provides a very favorable, uniform cleaning effect. At the same time, the use of compositions of the present type ensures that any non-self-emulsifying oil washed off collects on the surface of the storage baths and can then be separated off by mechanical means, for example, by means of annular-chamber boilers or separators. Emulsification is virtually eliminated so that the service life of the baths is significantly increased. However, the emulsifying effect can be intensified by additions of suitable emulsifiers, should this be necessary or desirable. The sprayable nonionic surfactants that can be used herein are preferably (i) addition products of ethylene oxide (EO) and/or propylene oxide (PO) with alkanols, amines, fatty acids or alkyl phenols, and/or (ii) block polymers of ethylene oxide and propylene oxide, and/or (iii) a polyethylene glycol polymer. Examples of such surfactants include the following:

$C_{12}$–$C_{14}$ alkanol + 3 PO
ethylenediamine + 30 EO + 60 PO
$C_{12}$–$C_{18}$ alkanol + 2 EO + 4 PO
$C_{12}$–$C_{14}$ alkanol + 5 EO + 4 PO
$C_{12}$–$C_{14}$ alkanol + 10 PO
propylene glycol-1,2 + 30 PO + 5 EO
propylene glycol-1,2 + 10 PO + 11 EO + 14 PO
polyethyleneglycol, M.W. 300

Another advantage of the compositions of the invention is that they permit automatic control of the cleaning operation and for metering of the cleaner solution. In the process of the invention, control and metering are governed by the conductivity of the cleaner solution, although phosphates do not have to be used for generating conductivity. Although electrolytes generally increase the erosion of lightweight metals to a considerable degree, practical levels of conductivity are established by using the phosphoric acid esters of the invention (component (a)) in combination with alkanolamines and/or alkanolamine salts of the invention (component (b)). Mixture of monoethanolamine, optionally in conjunction with other alkanolamines, and mono- and/or dicarboxylic acids, preferably isononanoic acid, are particularly suitable for obtaining very useful levels of conductivity. Builders, such as borates, gluconates, potassium hydroxide and/or aminopolycarboxylic acids or their salts, preferably ethylene diamine tetraacetate or nitrilotriacetate, are preferably added in order to increase the effectiveness of and to stabilize the present compositions.

The ingredients of the cleaning solutions of the invention are present in a total quantity of from about 5 to about 50 g/l, based on the weight of the cleaning solution.

The aqueous cleaning solutions of the invention, in which the pH-value is in the range of from about 7.5 to about 10.5, contain the following ranges of components:

| Component | Broad Range aporox. (g/l) | Preferred Range approx. (g/l) |
|---|---|---|
| (a) phosphoric acid ester | 0.01–1.0 | 0.01–0.3 |
| (b) alkanolamine | 0.25–25 | 1.0–10 |
| (c) sprayable nonionic surfactant | 0.001–1 | 0.01–0.5 |
| (d) builders, complexing agents and/or biocides | 0.025–30 | 1–20 |

In order to adjust the pH of the above solutions into the desired range, sodium or potassium hydroxide can be added, usually in a quantity of from about 0.05 to about 5 g/l.

The particular concentration in which the above components are used should be selected in such a way that the level of conductivity in the resulting cleaning solution is high enough for automatic metering and control while at the same time precipitates should not form.

Biocides, for example derivatives of hexahydrotriazine, such as the reaction product of monoethanolamine with formaldehyde, can optionally be added to the cleaning agents of the invention without affecting their crucial properties, such as their cleaning and passivating effect, their conductivity and their low foam level.

Non-ferrous metal inhibitors, for example mercaptobenzothiazole or benzotriazole, can also be added to the cleaning agents.

The concentrations of ingredients given above are most useful where the solution is used as a neutral cleaner. However, where the solution is used to passivate the metal as well, then since commercial treatment lines use relatively short contact times, e.g. within the range of about 15 seconds to about 5 minutes, preferably about 1 minute, for both spray and dip processes, it is advisable to have at least about 0.025 g/l phosphoric acid ester present in the above solution. Where the solutions are used to passivate metal in closed systems, such as cooling circuits, the phosphoric acid ester should be present in the solution in a quantity of at least about 0.30 g/l.

Aqueous concentrates containing the above ingredients can be prepared for shipping and storage, and these concentrates are then diluted with water to form the cleaning solutions of the invention. The concentrates contain the same weight ratio of ingredients as are present in the cleaning solution, i.e.

| Component | Concentrate Parts by weight, broad range | Parts by weight, preferred range |
|---|---|---|
| (a) phosphoric acid ester | 0.01–1.0 | 0.01–0.3 |
| (b) alkanolamine | 0.25–25 | 1.0–10 |
| (c) sprayable non-ionic surfactant | 0.001–1 | 0.01–0.5 |
| (d) builders, complexing agents and/or biocides | 0.025–30 | 1–20 |

In the above concentrate, the quantity of phosphoric acid ester present is greater than about 2 g/l, and is preferably in the range of from about 3 to about 15 g/l, but can rang up to the solubility limits of the individual components, provided that precipitates do not form at the particular concentration chosen.

The cleaning or passivating process using the cleaning solutions of the invention is carried out by contacting the metal surface to be treated using any convenient technique, such as spraying, dipping, brushing, etc., with spraying preferred, at a temperature of from about 20° C. to about 100° C. and preferably at a temperature in the range of from about 35 to about 70° C.

The cleaning and passivating solutions of the invention and also the cleaning and passivation process are illustrated by, but not limited to, the following Examples. In the Examples, the following procedures were employed: A. Production of the concentrates of the invention.

The acidic and alkaline components, the surfactants, the non-ferrous metal and lightweight inhibitors and, optionally, the biocides were added with stirring at room temperature to the quantity of water initially introduced. The water used in the individual Examples was either fully deionized water (FDW), tapwater (TW) or water in which a hardness of 5° d had been adjusted with magnesium sulfate or calcium chloride (5° d $Mg^{2+}$ or 5° d $Ca^{2+}$). B. Determining the erosion of aluminum and zinc.

A test solution was made up in a concentration shown in each Example and with a water defined above at room temperature. 1000 ml of each test solution was heated to 65° C. in a glass vessel. Test plates measuring 50×100 mm were immersed—hanging freely from a glass hook—in the mechanically stirred liquid and the glass vessel was covered. After 1 hour the test plate was removed, the liquid was cooled, adjusted with hydrochloric acid to approximately pH 2, and the volume of liquid was made up to 1000 ml with fully deionized water. The resulting liquid, containing hydrochloric acid, was filtered. In the event clouding occurred, the liquid was centrifuged.

The concentration of aluminium in the clear solution was determined either by atomic absorption or photometrically (535 nm filter) using eriochromocyanine in ammonium-acetate-buffered solution. The concentration of zinc was determined by atomic absorption. C. Determining the degree of inhibition.

The inhibiting properties of the agents of the invention on zinc, aluminium and aluminium alloys was determined using the determination described in B above. The degree of inhibition k is calculated in accordance with the following equation:

$$K = \frac{a - b}{a} \times 100$$

where k is the degree of inhibition in %, a is the concentration of metal ions in an inhibitor-free test solution, b is the concentration of metal ions in an inhibitor-containing test solution.

The Component (a) phosphoric acid esters used for preparing the cleaning solutions of the invention are given below:

| | |
|---|---|
| 1. monoester of phosphoric acid and $C_{12}$–$C_{18}$—alkanol + 10 EO, Na salt | approx. 30% of active substance (AS) |
| 2. monoester of phosphoric acid and $C_{14}$–$C_{16}$—alkanol + 6 EO, monoethanolamine salt | approx. 100% AS |
| 3. Acid phosphoric acid ester of a polyether Korantin ® LUB (BASF) | approx. 100% AS |
| 4. monoester of phosphoric acid and $C_{12}$–$C_{18}$—alkanol | approx. 100% AS |
| 5. reaction product of | |
| (a) 10 parts of dipropylene glycol and 282 parts of propylene oxide with | |
| (b) 30.5 parts of polyphosphoric acid (84%) | approx. 100% AS |

In the following Examples, the active substances of the aqueous concentrates are given in % by weight. The abbreviations EO and PO stand for ethylene oxide and propylene oxide, respectively.

EXAMPLE 1

7% monoethanolamine, 9% diethanolamine, 7% triethanolamine, 7% isononanoic acid, 7% of a mixture of branched $C_9$–$C_{11}$-carboxylic acids, 5% boric acid, 1% of phosphoric acid ester 1. (30%), 5% isotridecyl alcohol+3 PO, 52% fully deionized water (FDW).

Spraying temperature: above 35° C. to about 70° C.

EXAMPLE 2

7% monoethanolamine, 9% diethanolamine, 7% triethanolamine, 7% isononanoic acid, 7% of a mixture of branched $C_9$–$C_{11}$-carboxylic acids, 5% boric acid, 3% of phosphoric acid ester 1. (30%), 3% of an adduct of 30 EO and 60 PO with ethylene diamine, 2% of an adduct of 2 EO and 4 PO with a $C_{12}$–$C_{18}$-alkanol, 50% FDW.

Spraying temperature: above 45° C. to about 70° C.

EXAMPLE 3

7% monoethanolamine, 9% diethanolamine, 7% triethanolamine, 7% isononanoic acid, 7% of a mixture of branched $C_9$–$C_{11}$ carboxylic acids, 5% boric acid, 2% of phosphoric acid ester 1. (30%), 4% 2-ethylhexanol+3 PO, 1% of an adduct of 2 EO and 4 PO with a $C_{12}$–$C_{18}$-alkanol, 51% FDW.

Spraying temperature: above 50° C. to about 70° C.

EXAMPLE 4

7% monoethanolamine, 9% diethanolamine, 7% triethanolamine 7% isononanoic acid, 7% of a mixture of branched $C_9$–$C_{11}$ carboxylic acids, 5% boric acid, 2% of phosphoric acid ester 1. (30%), 5% of an adduct of 2

EO and 4 PO with a $C_{12}$–$C_{18}$ alkanol, 3% of an adduct of 5 EO and 4 PO with a $C_{12}$–$C_{14}$-alkanol, 48% FDW.

Spraying temperature: above 60° C. to about 70° C.

EXAMPLE 5

30% triethanolamine, 10% caprylic acid, 5% hexahydrotriazine derivative, 0.5% mercaptobenzothiazole, 0.3% of phosphoric acid ester 1. (30%), 3% of an adduct of 3 PO with isotridecyl alcohol, 51.2% FDW.

Spraying temperature: above 20° C. to about 70° C.

EXAMPLE 6

30% triethanolamine, 10% caprylic acid, 5% hexahydrotriazine derivative, 0.5% mercaptobenzothiazole, 1% of phosphoric acid ester 1. (30%), 3% of an adduct of 3 PO with isotridecyl alcohol, 3% of an adduct of 2 EO and 4 PO with a $C_{12}$–$C_{18}$-alkanol, 47.5% FDW.

Spraying temperature: above 30° C. to about 70° C.

EXAMPLE 7

30% triethanolamine, 10% caprylic acid, 5% hexahydrotriazine derivative, 0.5% mercaptobenzothiazole, 0.5% of phosphoric acid ester 1. (30%), 4% of an adduct of 2 EO and 4 PO with a $C_{12}$–$C_{18}$-alkanol, 1% of an adduct of 5 EO and 30 PO with 1,2-propylene glycol, 49% FDW Spraying temperature: above 45° C. to about 70° C.

EXAMPLE 8

30% triethanolamine, 10% caprylic acid, 5% hexahydrotriazine derivative, 0.5% mercaptobenzothiazole, 0.5% of phosphoric acid ester 2., 3% of an adduct of 2 EO and 4 PO with a $C_{12}$–$C_{18}$-alkanol, 3% of an adduct of 5 EO and 4 PO with a $C_{12}$–$C_{14}$-alkanol, 48% FDW.

Spraying temperature: above 55° C. to about 70° C.

EXAMPLE 9

20% diethanolamine, 10% sebacic acid, 10% isononanoic acid 1% of phosphoric acid ester 2., 5% of an adduct of 2 EO and 4 PO with a $C_{12}$–$C_{18}$-alkanol, 54% FDW.

Spraying temperature: above 60° C. to about 70° C.

EXAMPLE 10

20% triethanolamine, 10% benzene sulfonyl-N-methyl-ε-aminocaproic acid, 10% isononanoic acid, 3% of an adduct of 3 PO with a $C_{12}$–$C_{14}$-alkanol, 2% of phosphoric acid ester 1., 0.4% tetrasodium methylene diamine tetraacetate, 54.6% FDW.

Spraying temperature: above 30° C. to about 70° C.

EXAMPLE 11

30% diethanolamine, 5% benzene sulfonyl-N-methyl-ε-aminocaproic acid, 5% sebacic acid, 5% caprylic acid, 3% of an adduct of 3 PO with a $C_{12}$–$C_{14}$-alkanol, 2% of an adduct of 2 EO and 4 PO with a $C_{12}$–$C_{18}$-alkanol, 0.8% of phosphoric acid ester 2., 9.2% FDW.

Spraying temperature: above 35° C. to about 70° C.

The aluminium erosion values for the cleaning mixtures of Example 1 to 11, including the blank tests (a) and (b), are given in Table 1 below:

TABLE 1

| Mixture Example | Conc. g/l in TW | Temp. °C. | Time mins. | Aluminium and zinc erosion values: Al—alloy or Zn | Erosion mg $m^{-2}min.^{-1}$ | Degree of inhibition (%) |
|---|---|---|---|---|---|---|
| 1 | 20 | 65 | 60 | Al 99.5 | 0.45 | 98 |
| 2 | 20 | 65 | 60 | Al 99.5 | 0.51 | 97 |
| 3 | 10 | 65 | 60 | Al 99.5 | 0.57 | 98 |
| 4 | 10 | 65 | 60 | Al 99.5 | 0.46 | 98 |
| 5 | 25 | 45 | 60 | Al 99.5 | 0.49 | 94 |
| 6 | 20 | 55 | 60 | Al/Mg 0.5 Si 1.2 | 0.42 | 96 |
| 7 | 15 | 65 | 60 | Al 99.5 | 0.45 | 95 |
| 8 | 10 | 65 | 60 | Al 99.5 | 0.40 | 97 |
| 9 | 15 | 70 | 60 | Al 99.5 | 0.70 | 96 |
| 10 | 20 | 70 | 60 | Al 99.5 | 0.55 | 92 |
| 11 | 10 | 70 | 60 | Al 99.5 | 0.40 | 97 |
| (a) | 10 | 70 | 60 | Al 99.5 | 12.70 | — |
| 7 | 20 | 65 | 60 | Zn | 1.5 | 73 |
| (b) | 20 | 65 | 60 | Zn | 5.5 | — |

Remarks:
(a) for comparison: the mixture of Example 11 without phosphoric acid ester 2.
(b) for comparison: the mixture of Example 7 without phosphoric acid ester 1.

EXAMPLES 12 to 22

In addition to the phosphoric acid esters given in Table 2, the cleaning compositions of Examples 12 to 22 contained the following components: 45% water (FDW), 15% monoethanolamine, 15% triethanolamine, 10% caprylic acid, 5% ethylenediamine+30 EO+60 PO, 10% Versatic 10® (branched chain, saturated monocarboxylic acids having a chain length of about 9-11 carbon atoms-Shell Oil Co.).

The above mixture (mixture 1) was used in a concentration of 30 g/l in TW or FDW at a pH-value of 9.7.

The inhibiting properties of the compositions of the invention of Examples 12 to 22 are shown in Table 2. Examples 12, 17, 19 and 21 are Comparison Examples in which the cleaning mixture did not contain a phosphoric acid ester of the invention.

TABLE 2

| Example No. | Mixture | Concentration (g/l) | Water quality | Phosphoric Acid Ester No. | Phosphoric Acid Ester Conc. (ppm AS) | Al—Concentration (ppm) | Degree of Inhibition (%) |
|---|---|---|---|---|---|---|---|
| 12 | 1 | 30 | FDW | — | — | 22.5 | — |
| 13 | 1 | 30 | FDW | 1 | 100 | 0.45 | 98 |
| 14 | 1 | 30 | FDW | 1 | 1,000 | 0.16 | 99.3 |

TABLE 2-continued

| Example No. | Mixture | Concentration (g/l) | Water quality | Phosphoric Acid Ester No. | Phosphoric Acid Ester Conc. (ppm AS) | Al—Concentration (ppm) | Degree of Inhibition (%) |
|---|---|---|---|---|---|---|---|
| 15 | 1 | 30 | FDW | 3 | 100 | 0.13 | 99.4 |
| 16 | 1 | 30 | FDW | 5 | 100 | 2.3 | 90 |
| 17 | 1 | 30 | 5° $dMg^{2+}$ | — | — | 7.2 | — |
| 18 | 1 | 30 | 5° $dMg^{2+}$ | 1 | 100 | 0.53 | 93 |
| 19 | 1 | 30 | 5° $dCa^{2+}$ | — | — | 18.8 | — |
| 20 | 1 | 30 | 5° $dCa^{2+}$ | 1 | 100 | 0.37 | 98 |
| 21 | 1 | 30 | TW | — | — | 28.5 | — |
| 22 | 1 | 30 | TW | 1 | 100 | 2.7 | 91 |

EXAMPLES 23 to 29

In addition to the phosphoric acid esters shown in Table 3, the cleaning agents of Examples 23 to 29 contained the following components: 45% water (FDW), 10% monoisopropanolamine, 10% diisopropanolamine, 10% diethanolamine, 10% triethanolamine, 5% ethylenediamine+30 EO+60 PO, and 10% boric acid.

This mixture (mixture 2) was used in a concentration of 25 g/l in TW or FDW at a pH-value of 9.6.

The inhibiting properties of the compositions of the invention of Examples 23 to 31 are given in Table 3. Examples 23 and 27 are Comparison Examples in which the cleaning compositions did not contain a phosphoric acid ester.

TABLE 3

| Example No. | Mixture | Concentration (g/l) | Water guality | Phosphoric Acid Ester No. | Phosphoric Acid Ester Conc. (ppm AS) | Al—Concentration (ppm) | Degree of Inhibition (%) |
|---|---|---|---|---|---|---|---|
| 23 | 2 | 25 | FDW | — | — | 63.2 | — |
| 24 | 2 | 25 | FDW | 3 | 120 | 0.19 | 99.7 |
| 25 | 2 | 25 | FDW | 4 | 120 | 0.05 | 99.9 |
| 26 | 2 | 25 | FDW | 5 | 120 | 0.19 | 99.7 |
| 27 | 2 | 25 | TW | — | — | 36.5 | — |
| 28 | 2 | 25 | TW | 2 | 120 | 3.0 | 92 |
| 29 | 2 | 25 | TW | 3 | 120 | 4.2 | 88 |

EXAMPLES 30 to 32

In addition to the phosphoric acid esters set forth in Table 4, the cleaning compositions of Examples 30 to 32 contained the following components: 50% FDW, 20% triethanolamine, 10% sodium gluconate, 10% glycerol, 8% polyethylene glycol (molecular weight 300) and 2% benzotriazole.

This mixture (mixture 3) was used in a concentration of 10 g/l in FDW at a pH-value of 8.6.

The inhibiting properties of the compositions of the invention of Examples 30 to 32 are given in Table 4. Example 30 is a Comparison Example in which the cleaning composition did not contain a phosphoric acid ester.

TABLE 4

| Example No. | Mixture | Concentration (g/l) | Water quality | Phosphoric Acid Ester No. | Phosphoric Acid Ester Conc. (ppm AS) | Al—Concentration (ppm) | Degree of Inhibition (%) |
|---|---|---|---|---|---|---|---|
| 30 | 3 | 10 | FDW | — | — | 10.1 | — |
| 31 | 3 | 10 | FDW | 4 | 120 | 0.16 | 98 |
| 32 | 3 | 10 | FDW | 5 | 120 | 0.37 | 96 |

EXAMPLES 33 to 41

In addition to the phosphoric acid esters set forth in Table 5, the cleaning compositons of Examples 33 to 41 contained the following components: 51% FDW, 7% monoethanolamine, 9% diethanolamine, 7% triethanolamine, 7% isononanoic acid, 7% Versatic 911® (branched chain, saturated monocarboxylic acids having a chain length of about 9–11 carbon atoms-Shell Oil Co.), 5% boric acid, 5% sodium gluconate and 2% of an adduct of 5 EO and 30 PO with propylene glycol.

This mixture (mixture 4) was used in a concentration of 20 g/l in FDW or TW at a pH-value of 9.2.

The inhibiting properties of the compositions of the invention of Examples 33 to 41 are shown in Table 5. Examples 33, 36 and 39 are Comparison Examples in which the cleaning agents did not contain a phosphoric acid ester.

TABLE 5

| Example No. | Mixture | Concentration (g/l) | Water quality | Phosphoric Acid Ester No. | Phosphoric Acid Ester Conc. (ppm AS) | Al—Concentration (ppm) | Degree of Inhibition (%) |
|---|---|---|---|---|---|---|---|
| 33 | 4 | 20 | FDW | — | — | 23.0 | — |
| 34 | 4 | 20 | FDW | 1 | 300 | 0.24 | 99 |

TABLE 5-continued

| Example No. | Mixture | Concentration (g/l) | Water quality | Phosphoric Acid Ester No. | Phosphoric Acid Ester Conc. (ppm AS) | Al—Concentration (ppm) | Degree of Inhibition (%) |
|---|---|---|---|---|---|---|---|
| 35 | 4 | 20 | FDW | 4 | 300 | 0.22 | 99 |
| 36 | 4 | 20 | TW | — | — | 4.0 | — |
| 37 | 4 | 20 | TW | 1 | 20 | 0.40 | 90 |
| 38 | 4 | 20 | TW | 3 | 300 | 0.26 | 94 |
| 39 | 4 | 30 | TW | — | — | 3.2 | — |
| 40 | 4 | 30 | TW | 2 | 120 | 0.21 | 93 |
| 41 | 4 | 30 | TW | 2 | 300 | 0.26 | 92 |

We claim:

1. An aqueous composition for cleaning or passivating metal surfaces constisting essentially of (a) from about 0.01 to about 1.0 g/l of at least one phosphoric acid ester selected from the following:

(i) mono- or diester of phosphoric acid with $C_{10}$–$C_{20}$ alkanols, (ii) mono- or diester of phosphoric acid with $C_2$–$C_3$ alkoxylated $C_{10}$–$C_{20}$ alkanols, (iii) phosphoric acid ester of poly-$C_2$–$C_3$-aklylene glycol ether, (iv) a water solube salt of any of the foregoing;

(b) from about 0.25 to about 25 g/l of at least one alkanolamine or carboxylic acid salt of said alkanolamine;

(c) from about 0.001 to about 1 g/l of at least one nonionic surfactant.

2. A composition in accordance with claim 1 wherein component (a) is present in from: about 0.01 to about 0.3 g/l component (b) is present in form about 1.0 to about 10 g/l and component (c) is present in from about 0.01 to about 0.5 g/l.

3. A composition in accordance with claim 1 wherein component (a) contains an alkali metal, ammonium, or alkanolamine salt of a monoester of phosphoric acid with an ethoxylated linear $C_{10}$–$C_{20}$ alkanol.

4. An aqueous composition in accordance with claim 1 wherein the carboxylic acid salt of said alkanolamine in component (b) is the benzene sulfonyl-N-methyl-ϵ-aminocaproic acid salt of said alkanolamine.

5. An aqueous composition in accordance with claim 1 wherein the composition also contains one or more of (d) a non-phosphate builder;

(e) a non-ferrous metal inhibitor; and (f) a biocide, and wherein the total quantity of components (a) through is in the range of from about 5 to about 50 g/l.

6. A composition in accordance with claim 5 wherein the composition contains as component (d) at least one of the following builders: a borate, a gluconate, potassium hydroxide, and an aminopolycarboxylic acid or salt thereof.

7. A composition in accordance with claim 1 wherein the pH is in the range of from about 7.5 to about 10.5.

8. An aqueous concentrated composition consisting essentially of (a) from about 0.001 to about 1.0 parts by weight of at least one phosphoric acid ester selected from the following:

(i) mono- or diester of phosphoric acid with $C_{10}$–$C_{20}$ alkanols, (ii) mono- or diester phosphoric acid with $C_2$–$C_3$ alkoxylated $C_{10}$–$C_{20}$alkanols, (iii) phosphoric acid ester of poly-$C_2$–$C_3$-alkylene glycol ether, (iv) a water solube salt of any of the foregoing;

(b) from about 0.25 to about 25 parts by weight of at least one alkanolamine or carboxylic acid salt of said alkanolamine;

(c) from about 0.001 to about 1 parts by weight of at least one nonionic surfactant;

wherein component (a) above is present in amount greater than about 2 g/l of the concentrated composition.

9. An aqueous concentrated composition in accordance with claim 8 wherein from about 0.01 to about 0.3 parts by weight of component (a) are present; from about 1.0 to about 10 parts by weight of component (b) are present; and from about 0.01 to about 0.5 parts by weight of component (c) are present.

10. An aqueous concentrated composition in accordance with claim 8 wherein component (a) contains an alkali metal, ammonium or alkanolamine salt of a monoester of phosphoric acid with an ethoxylated linear $C_{10}$–$C_{20}$ alkanol.

11. An aqueous concentrated composition in accordance with claim 8 wherein the composition also contains one or more of (d) a non-phosphate builder;

(e) a non-ferrous metal inhibitor; and (f) a biocide.

12. An aqueous concentrated composition in accordance with claim 11 wherein the composition contains as component (d) at least one of the following builders: a borate, a gluconate, potassium hydroxide, and an aminopolycarboxylic acid or salt thereof.

13. A process for cleaning or passivating a metal surface or both cleaning and passivating a metal surface comprising contacting the metal surface with the composition of claim 1 at a temperature in the range of from about 20° C. to about 100° C.

14. A process in accordance with claim 13 wherein the temperature is in the range of from about 35° C. to about 70° C.

15. A process in accordance with claim 13 wherein the composition employed therein is the composition of claim 9.

16. A process in accordance with claim 13 wherein the composition employed therein is the composition of claim 2.

17. A process in accordance with claim 13 wherein the composition employed therein is the composition of claim 3.

18. A process in accordance with claim 13 wherein the composition employed therein is the composition of claim 6.

19. A process in accordance with claim 13 wherein the composition employed therein is the composition of claim 7.

* * * * *